US008550389B2

(12) United States Patent
Chen

(10) Patent No.: US 8,550,389 B2
(45) Date of Patent: Oct. 8, 2013

(54) IMP MILL HAVING A UNIFORM WEAR HAMMER ARRANGEMENT

(75) Inventor: Michael M. Chen, Naperville, IL (US)

(73) Assignee: ALSTOM Technology Ltd, Baden (CH)

( * ) Notice: Subject to any disclaimer, the term of this patent is extended or adjusted under 35 U.S.C. 154(b) by 971 days.

(21) Appl. No.: 12/179,998

(22) Filed: Jul. 25, 2008

(65) Prior Publication Data

US 2010/0019074 A1 Jan. 28, 2010

(51) Int. Cl.
*B02C 13/09* (2006.01)

(52) U.S. Cl.
USPC ..... 241/188.1; 241/194; 241/197

(58) Field of Classification Search
USPC ..... 241/189.1, 194, 195, 197
See application file for complete search history.

(56) References Cited

U.S. PATENT DOCUMENTS

| | | | | | |
|---|---|---|---|---|---|
| 3,561,686 | A * | 2/1971 | Hedrick | 241/197 |
| 4,274,601 | A | 6/1981 | Musto | |
| 4,610,401 | A * | 9/1986 | Maliszewski | 241/294 |
| 4,773,601 | A * | 9/1988 | Urich et al. | 241/101.761 |
| 4,819,886 | A * | 4/1989 | Lambert | 241/186.1 |
| 5,178,335 | A * | 1/1993 | Mertens | 241/73 |
| 5,269,477 | A * | 12/1993 | Buchholtz et al. | 241/293 |
| 5,454,521 | A * | 10/1995 | Frazier et al. | 241/51 |
| 5,722,607 | A * | 3/1998 | Hellmich | 241/189.1 |
| 5,772,134 | A * | 6/1998 | Bouldin et al. | 241/79.1 |
| 6,073,866 | A * | 6/2000 | Silver et al. | 241/19 |
| 6,227,469 | B1 * | 5/2001 | Daniels et al. | 241/186.3 |
| 6,419,173 | B2 * | 7/2002 | Balvanz et al. | 241/291 |
| 6,629,805 | B1 * | 10/2003 | Eischeid | 408/228 |
| 2002/0125353 | A1 * | 9/2002 | Bardos et al. | 241/30 |
| 2006/0065768 | A1 * | 3/2006 | Elliott | 241/195 |
| 2008/0011890 | A1 * | 1/2008 | Young | 241/195 |
| 2008/0041992 | A1 * | 2/2008 | Hall et al. | 241/189.1 |

* cited by examiner

*Primary Examiner* — Mark Rosenbaum

(57) ABSTRACT

A hammermill, such as an imp mill 10, for pulverizing material includes a housing 16 defining a grinding chamber 14 having a grinding apparatus 12 disposed therein. The material is fed into the grinding chamber to the grinding apparatus through an inlet conduit 24, and the resulting ground material is directed from the grinding chamber through an outlet conduit 28. The grinding apparatus includes a plurality of hammer disks 32 axially spaced along a rotor 34, wherein disks 32 are disposed within the grinding chamber 14. A plurality of rows 41-46 of hammers 30 is attached to the hammer disks 32. The hammers 30 of each respective row of hammers are circumferentially spaced around the hammer disks 32, wherein each row of hammers is formed to provide generally uniform wear across each row of hammers. The uniform wear may be achieved by forming the hammers 30 of different hardness or wear resistant qualities, and/or configuring the rows of hammers with different shapes.

18 Claims, 5 Drawing Sheets

IMP MILL HAVING A UNIFORM WEAR HAMMER ARRANGEMENT

TECHNICAL FIELD

The present disclosure relates generally to a hammermill, such as am imp mill, and more particularly, to an imp mill having a hammer arrangement that provides substantially uniform wear of the hammers.

BACKGROUND

A number of processes require the grinding of material using many types of apparatus to grind different kinds of materials. One such grinding apparatus is an imp mill, which is a particular type of hammermill. The imp mill is one form of pulverizer commonly employed for reducing the size of minerals, organics and chemicals. One of the earliest uses to which imp mills were put was that of the pulverization of coal, and particularly in those applications wherein it was desired to pulverize the coal for direct firing. Imp mills are also widely used in the complete processing of such products as organic insecticides, soya flour, starches, litharge for storage batteries, phosphate materials, synthetic resins, potassium compounds, clay materials and in literally dozens of other applications in which precision grinding and drying are an important part of the production process.

Imp mills generally have a plurality of hammers suitably attached to a row of disks, which in turn are attached to a rotor shaft, of which are housed within a cylindrical grinding chamber. The grinding chamber has an air inlet and an air outlet disposed to allow forced air to pass through the grinding chamber and carry pulverized material (i.e., coal) of a desired size out of the imp mill. Each row of hammers includes a plurality of hammers disposed circumferentially around a corresponding disk or pair of adjacent discs. The hammers may be fixed rigidly or pivotally pinned to the disks. As the rotor and disks are rotated by a motor, material is fed into one end of the grinding chamber. The rotating hammers crush and pulverize the material as the material progresses through the grinding chamber. The dimensions of the disks and hammers, number of hammers, rotor speed, the flow rate of the air through the grinding chamber, and the dimensions of the grinding chamber determine the particle size exiting the outlet of the imp mill.

In a normal operation of an imp mill, the first row of hammers where the material feeds in functions as pre-crushers. In other words, the first row provides the grinding and crushing of the initial particles, which are the larger particles. The first row of hammers is therefore subject to more severe wear than the other rows of hammers. Consequently, the hammers in the first row wear quicker than the rest of the hammers. The premature wear of the first row of hammers results in a shorter life cycle for all the hammers because all the hammers are typically replaced at the same time as the replacement of the first row hammers. Another disadvantage of the premature wear of the worn first row of hammers is the resulting vibration of the mill rotor due to rotor imbalance cause by uneven wear with certain hammer configurations.

A need therefore arises for an imp mill that provides a relatively consistent or uniform wear across all the hammers of the mill, particularly the premature wear of the first row of hammers. The uniform wear of the hammers results in a consistent grind (i.e., particle size) throughout the life of the hammers. Further, the reduced wear of the first row of hammers results in less hammers being changed, and thus longer hammer life, less down time, and less time spent changing the hammers. Uniform hammer wear will also maintain rotor balance and thus avoid vibration due to uneven wear. Such an imp mill results in lower total hammer, labor, and maintenance costs, as well as lower unit energy consumption.

SUMMARY

According to the aspects illustrated herein, an apparatus for pulverizing material is provided, which includes a housing that defines a grinding chamber. Further, an inlet conduit feeds the material into the grinding chamber. An outlet conduit directs pulverized material from the grinding chamber. A plurality of hammer disks is axially spaced along a shaft, wherein the hammer disks are disposed within the grinding chamber. A plurality of rows of hammers is attached to the hammer disks. The hammers of each respective row of hammers are circumferentially spaced, wherein each row of hammers is formed to provide generally uniform wear across each row of hammers.

According to another aspect illustrated herein, an apparatus for pulverizing material is provided, which includes a housing defining a grinding chamber. An inlet conduit feeds the material into the grinding chamber, while an outlet conduit directs pulverized material from the grinding chamber. A plurality of hammer disks are axially spaced along a shaft, wherein the hammer disks are disposed within the grinding chamber. A plurality of rows of hammers is attached to the hammer disks. The hammers of each respective row of hammers are circumferentially spaced, wherein hammers of at least two different rows have different shapes.

The above described and other features are exemplified by the following figures and detailed description.

BRIEF DESCRIPTION OF THE DRAWINGS

Referring now to the Figures, which are exemplary embodiments, and wherein the like elements are numbered alike.

DETAILED DESCRIPTION

Figure 1:
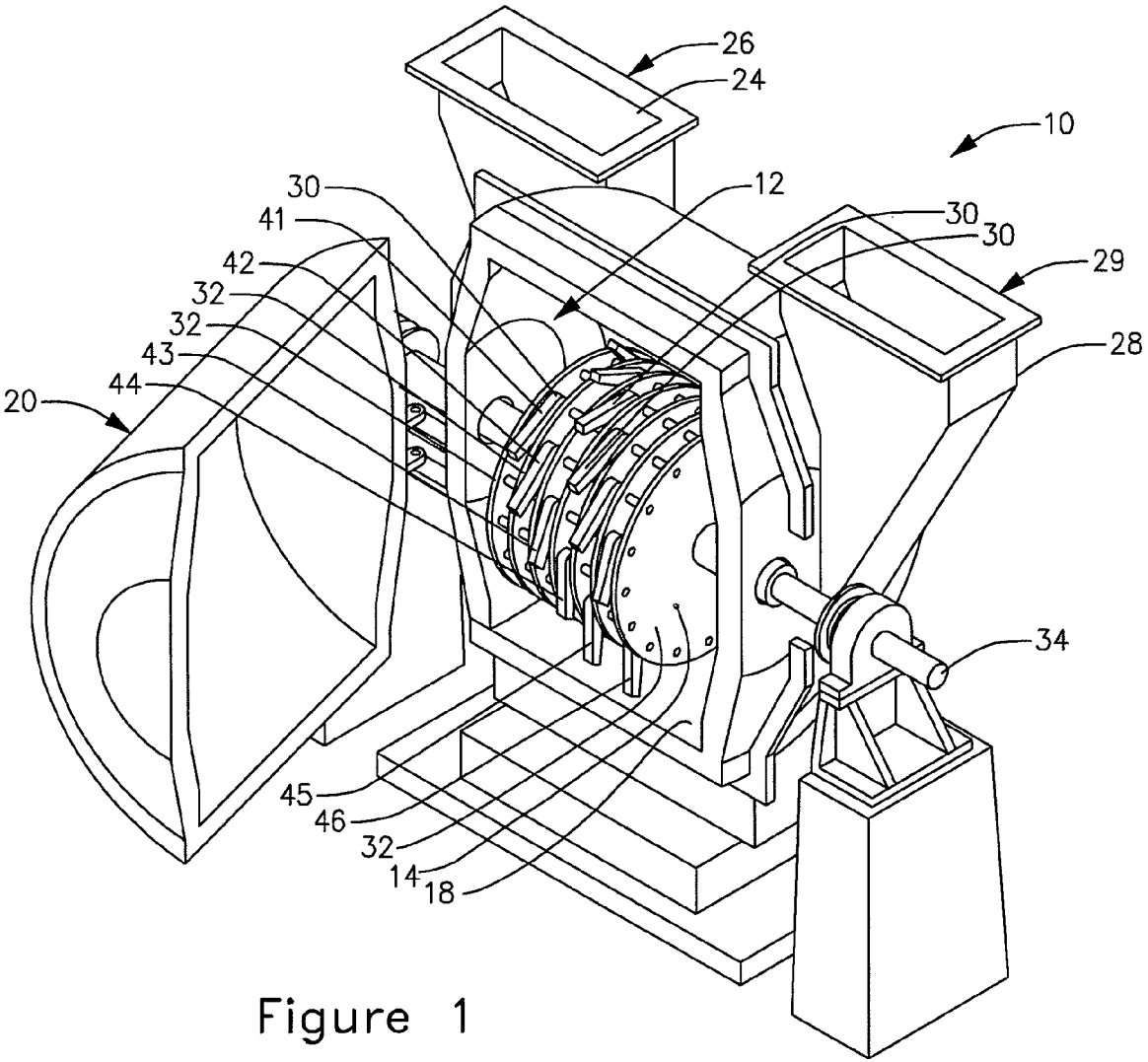
FIG. 1 is a perspective view of an imp mill in accordance to the present invention.

An imp mill 10, as shown in FIG. 1, for pulverizing, grinding, or crushing material is provided in accordance with exemplary embodiments. The imp mill in accordance with the present invention will be described as such that pulverizes coal, however, one will appreciate that the present invention may be used to grind or pulverize any suitable material as described hereinbefore. The exemplary embodiments described provide a grinding apparatus 12 whereby the grinding elements 30 (e.g., hammers) wear at a relatively comparable rate, particularly the wear of the first row of hammers as compared to the remaining rows of hammers.

Turning now to FIG. 1, the imp mill 10 for pulverizing material (i.e., coal) will now be described in accordance with exemplary embodiments. Referring to FIG. 1, the imp mill includes the grinding apparatus 12 disposed in a grinding chamber 14. The grinding chamber 14 is defined by a generally cylindrical housing 16 having an interior liner 18 disposed therein. A portion 20 of the housing 16 is releasably attached to the imp mill 10 to permit maintenance of the grinding apparatus 12. The removal portion 20 maybe attached by quick release latches (not shown). The mill includes an inlet conduit 24 disposed at an input end 26 of the mill and an outlet conduit 28 disposed at an output end 29 of the mill, whereby the grinding apparatus is disposed therebetween. The inlet conduit 26 receives unground or raw material for depositing the coal into the grinding chamber. The resulting ground coal exits the outlet conduit 28 with an air stream that flows in through the inlet conduit, then passes through the grinding chamber and exits the mill through the outlet conduit.

The grinding apparatus 12 includes a plurality of hammers 30 piovtally attached to a plurality of hammer disks 32, thus allowing the hammers to move on impact with the material to be crushed and thereby reduce the stress on the hammers. The hammer disks 32 are attached axially along a portion of a rotor 34 shown disposed horizontally. In the exemplary embodiment shown, the grinding apparatus 12 comprises seven (7) axially-spaced hammer disks 32 whereby each row of hammers 30 disposed thereon are disposed in a corresponding spacing between the hammer disks. As such, the exemplary embodiment shown in FIG. 1 includes six (6) rows of hammers, wherein each row is designated as 41,42,43,44, 45,46, respectively. The first row 41 of hammers 30 is disposed closest to the input end 26 of the grinding chamber 12 and the sixth row 46 of hammers is dispose in the spacing closest to the output end 30 of the grinding chamber. The second row through the fifth row 42-45 of hammers is disposed therebetween in numerical order in the corresponding spacing between the hammer disks 32.

Each of the six (6) rows 41-46 of hammers 30 is therefore disposed axially along the rotor 34. Each row of hammers includes a plurality of hammers circumferentially-spaced around the hammer disks 32. The circumferential spacing of the hammers of each row of hammers is shown to be approximately equally spaced. Further, the hammers of each row have diametrically opposed hammers to evenly distribute the mass around the respective hammer disk to thus reduce vibration and wear of the rotor 34 and bearings 36. The hammers are normally staggered aligned from row to row. The shape of each hammer in each row is shown to be generally bar-shaped, similar to that shown in FIG. 2*b*.

One embodiment of the present invention shown in FIG. 1 utilizes a high wear resistant material to ensure that the hammers 30 wear at a relatively comparable rate. Specifically, the imp mill 10 includes selected hammers or rows of hammers 30 formed of or coated with high wear resistant material, such as tungsten carbide weld overlay and/or chromium carbide overlay, that experience less comparable wear than hammers of the other rows. For instance, as noted herein before, the first row 41 of hammers 30 experience higher wear compared to the other rows 42-46 of hammers 30, and therefore the present invention contemplates that at least the first row of hammers are formed of or coated with the higher wear resistant material. Further, the hammers 30 may be formed of the same material, however, the material of the first row of hammers has a higher hardness. Alternatively, the greater hardness or wear resistance characteristic may be achieved during the manufacturing process by using different heat treatments on hammers having the same material.

While the imp mill 10 described hereinbefore provides a first row 41 of hammers 30 having a greater hardness or wear resistance, the present invention contemplates that the hammers 30 of each row 41-46 may have different degrees of hardness or wear resistance so the wear across each row of hammers is comparably uniform. In one example, the wear resistance of each row 41-46 of hammers 30 incrementally increases from the sixth row 46 of hammers to the first row 41 of hammers. Alternatively, the wear resistance of each row 41-46 of hammers 30 may be defined in accordance with a wear pattern defined by empirical or experimental data, possibly resulting in non-uniform wear patterns over each row of hammers, as suggested, hereinbefore. One such wear pattern may include a pattern whereby the wear of the hammers in the first three rows incrementally decrease, while the next two rows have similar wear which is less than the third row. For this example, the hardness or wear resistance of the first three rows 41-43 would incrementally decrease, and the hardness or wear resistance of the last three rows 44-46 would be substantially the same, but less than the hammers of the third row 43. Further, the last row 46 of hammers 30 also may exhibit higher wear than the intermediate rows 42-45 rows of hammers, but less wear than the first row 41 of hammers. Therefore, the present invention contemplates that the last row may also be formed to have a higher wear or coated with the higher wear material similar to the first row of hammers, or formed or coated to have wear resistance less than the first row 41 of hammers but greater than the intermediate rows 42-45 of hammers.

Figure 2D:
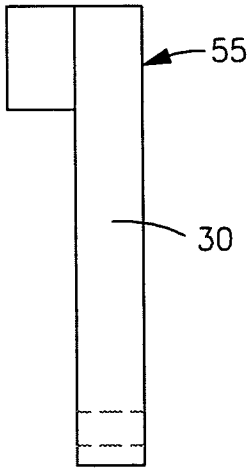
FIGS. 2*a*-*d* are front elevational views of different shapes of hammers that may be used in a hammer mill, similar to that of FIG. 1 in accordance with the present invention.
Figure 2C:
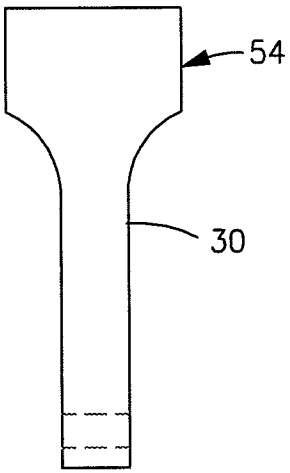
Figure 2B:
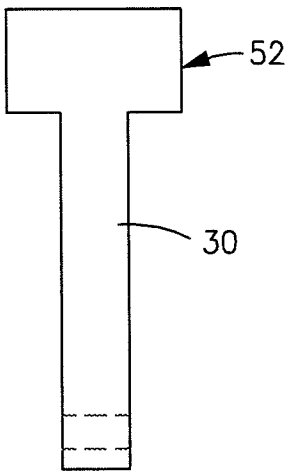
Figure 2A:
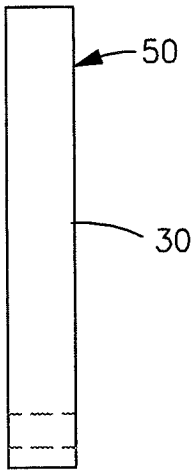

In another embodiment of the present invention the imp mill 30 of FIG. 1 may utilize different hammer shapes to achieve comparable uniform hammer wear across the rows of hammers. Referring to FIGS. 2*a*-2*d*, examples of different hammer shapes are illustrated. FIG. 2*a* shows a bar hammer 50 having a generally straight rectangular shape. FIG. 2*b* shows a generally T-shaped hammer 52. FIG. 2*c* illustrates a club hammer 54 having a generally rectangular paddle shape. FIG. 2*d* illustrates a generally L-shaped hammer 55. The shape and dimensions of a hammer is a factor in its resistance to wear. For instance with all other factors being the same, club hammers 54 have a higher resistance to wear than the bar, T-shaped, and L-shaped hammers 50,52,55 respectively. Further, the T-shaped hammer has a higher resistance to the L-shaped and bar hammers, while the L-shaped hammer has a higher wear resistance than the bar hammer.

As described hereinbefore and shown in FIG. 1, each row 41-46 of hammers 30 crush increasingly smaller particles of material than the previous row of hammers as the particles progress from the first row 41 to the sixth row 46 of hammers of the grinding apparatus 12. The first row of hammers crush the big feed size material provided through the input inlet conduit 24, and therefore is subjected to greater wear. As the material progresses through the grinding apparatus 12, each subsequent row of hammers is generally subject to finer particles and thus less wear. However, as described hereinbefore, the last row may wear at a faster rate than the intermediate rows 42-45 of hammers 30, but at a lesser rate than the first row 41 of hammers.

To overcome the uneven wear of the hammers 30, the present invention contemplates an imp mill 10 having a plurality of rows 41-46 of hammers whereby the shapes of the hammers of at least one row is different than one or more other rows. Generally, the present invention contemplates that depending upon a number of factors, each row of hammers has a shape or design such that the hammers of the mill substantially wear at a similar rate, which reduces the need to replace a particular hammer or row of hammers prematurely or before the replacement of the other hammers. Some of the factors for determining the shape include the material being ground (e.g., the hardness and size of the material), the rate of flow of the material, the desired fineness of the resulting ground material, the number of rows of hammers, the number of hammers in each row, the material of hammers, and the rate of rotation of the rotor.

Figure 3A:
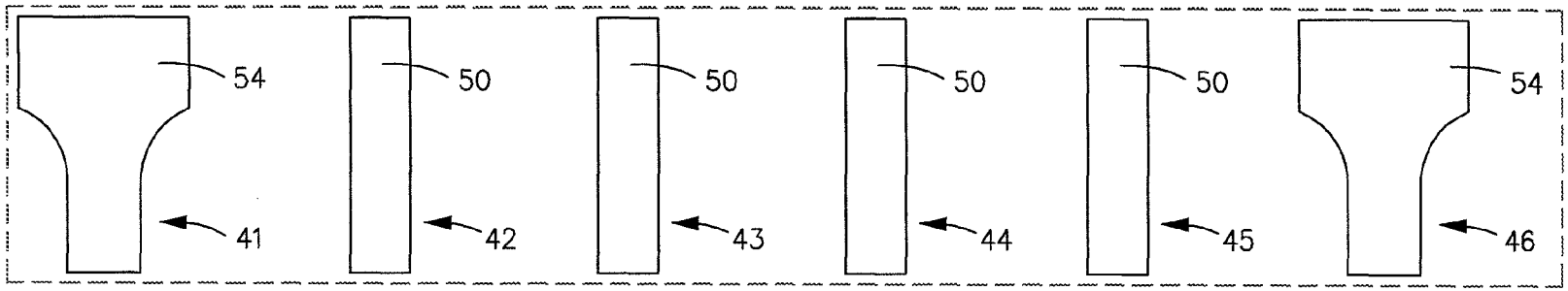
FIGS. 3*a*-3*c* are schematic views of different patterns or sequences of hammer shapes of respective rows of hammers in accordance with the present invention.
Figure 3B:
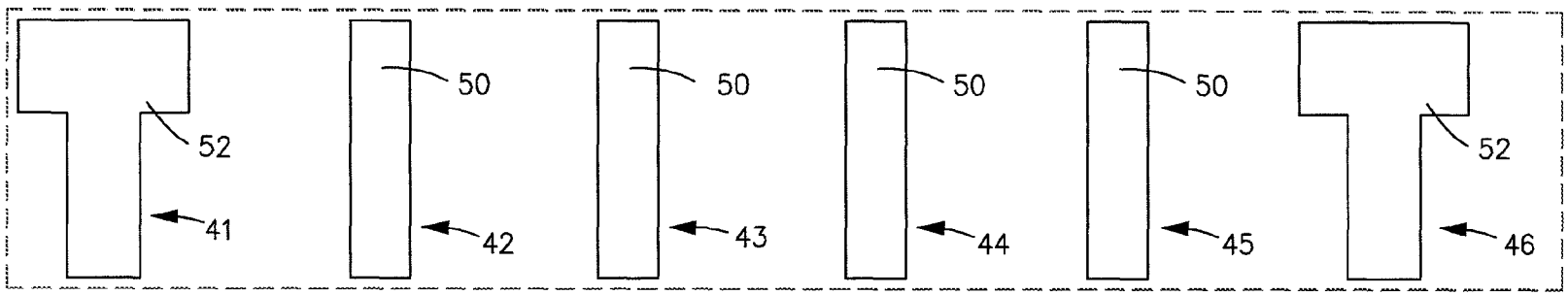
Figure 3C:
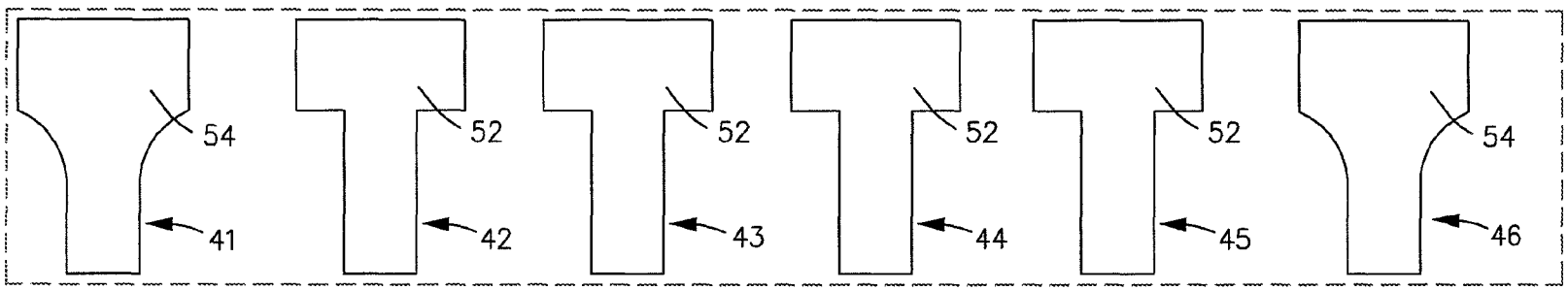

FIGS. 2*a*-2*c* illustrate hammers 30 of a plurality of rows 41-46, which may be used in an imp mill 10, wherein each row of hammers has a shape such that the rows of hammers wear uniformly compared to the other rows. As described hereinbefore, the shape of a hammer, which is formed of the same or similar material, is a factor in its rate of wear. The wear resistance of each of the different shaped hammers is different. For example, the club hammer 54 has a greater resistance to wear than the T-shaped and bar hammers 52,50, respectively. As shown in FIG. 3*a*, the first row and last row of hammers 41,46, respectively, have shapes that have a greater wear resistance than the rows of hammers 42-45 therebetween. The present invention further contemplates that the shapes of the hammers in each row may vary even more to accommodate an imp mill having a different wear pattern to the rows of hammers. One example, is that the hammers of the last row in FIG. 3*a* may be a T-shaped hammer 52 or an L-shaped hammer, if the last row of hammers 46 wears less than the first row of hammers 41, but more than the row of hammers therebetween 42-45. Also, the last row of hammers 46 in the configuration shown in FIG. 3*b* may be an L-shaped hammer 55 for the same reason. Furthermore, it is contemplated that the intermediate rows of hammers 42-45 may have different shapes (e.g., not the same shapes). Further consideration in the configuration of the rows of hammers is that the T-shaped and club hammers are more suitable for crushing or pulverizing the finer materials, and therefore, are more suitable to be disposed in the last row 46 or rows, which will be described in greater detail hereinafter.

In yet another embodiment of the present invention, the shapes of the hammers for each row may be disposed so as to control the particle size of the material being ground in an economical fashion. An optimized configuration of shaped hammers may minimize the number of hammers necessary to pulverize the material to the desired particle size, resulting in less hammers and thus reducing the weight and energy consumption. FIGS. 4*a*-4*e* illustrate examples of different economical configurations of hammer shapes for each row of hammers of an exemplary imp mill.

The functionality and energy consumption of the hammers differ depending on the shape of the hammer. For instance, the bar hammers 50 are better suited for crushing the raw material entering the mill through the input conduit, while the club hammer 54 is better suited for pulverizing the smaller particle. The L-shaped and T-shaped hammers' functionality falls in between the functionality of the bar and club hammers in that the L-shaped and T-shaped hammers 52,55, respectively, crush particles finer than the bar hammers, while the L-shaped and T-shaped hammers are more suitable to crush the larger sized particles (e.g. raw material) than the club hammers. Furthermore, the functionality and energy consumption of the L-shaped hammer is related closer to the bar hammer, while the functionality and energy consumption of the T-shaped hammer to related closer to the club hammer. Therefore, the present invention further contemplates that the mill has rows of different shaped hammers based on the position of the row of hammers relative to the other rows and the desired particle size. For instance, the bar hammers may be disposed in at least the first rows of hammers 41 of the mill while the club hammers are disposed in at least the last rows 45 of hammers with the intermediate rows being bar shaped, club shaped, L-shaped and/or T-shaped. Examples of such configurations are illustrated in FIGS. 4*a*-4*e*. The economical impact may also be considered in the configuration of the shapes of the hammers of each row.

Figure 4A:
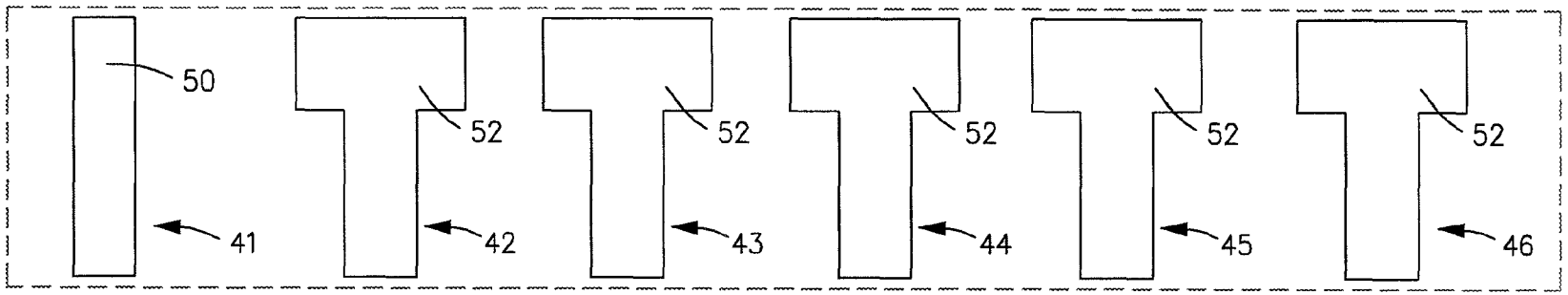
FIGS. 4*a*-4*e* are schematic views of different patterns or sequences of hammer shapes of respective rows of hammers in accordance with the present invention.
Figure 4B:
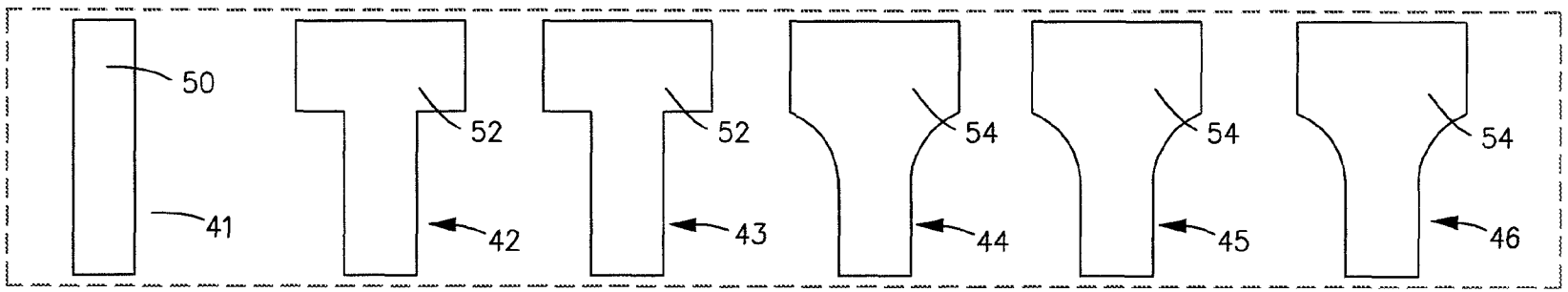
Figure 4C:
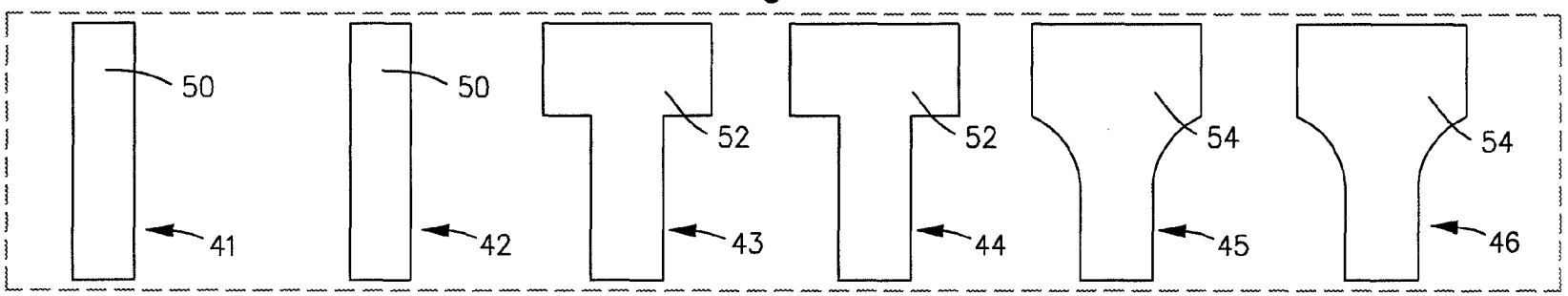
Figure 4D:
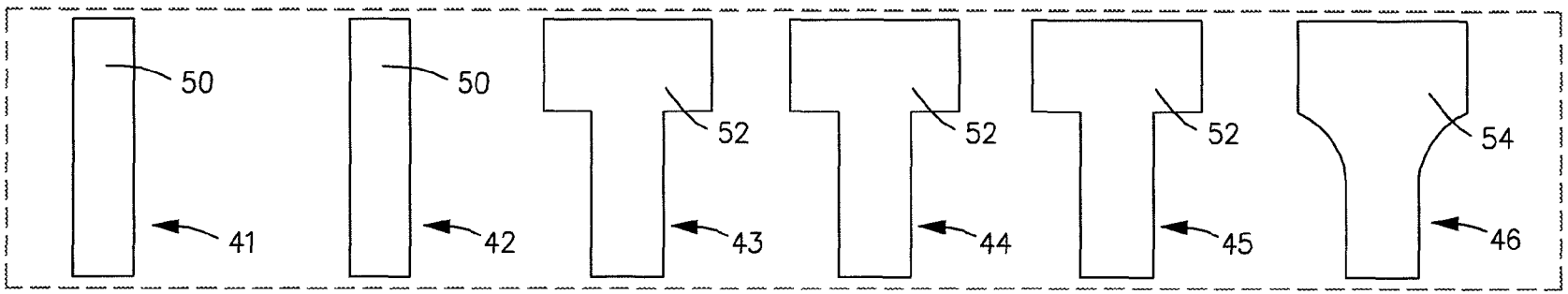

In one exemplary embodiment, the first row 41 of hammers 30 for crushing the larger particles of material may include one particular shape having a better ability to crush larger sized particles than the subsequent rows 42-46 of hammers. For example as shown in FIG. 4*a*, the first row 41 of hammers may be bar hammers 50, which are designed for crushing the big feed size material, so that less energy is needed. For the subsequent rows 42-46 of hammers, T-shaped hammers 52 may be used for fine grinding to achieve the final grind. Further, the first row of hammers require less inertia to break up the material due to the high inertia in the feed material, while the subsequent rows of hammers requires more momentum to break up the finer material.

Figure 4E:
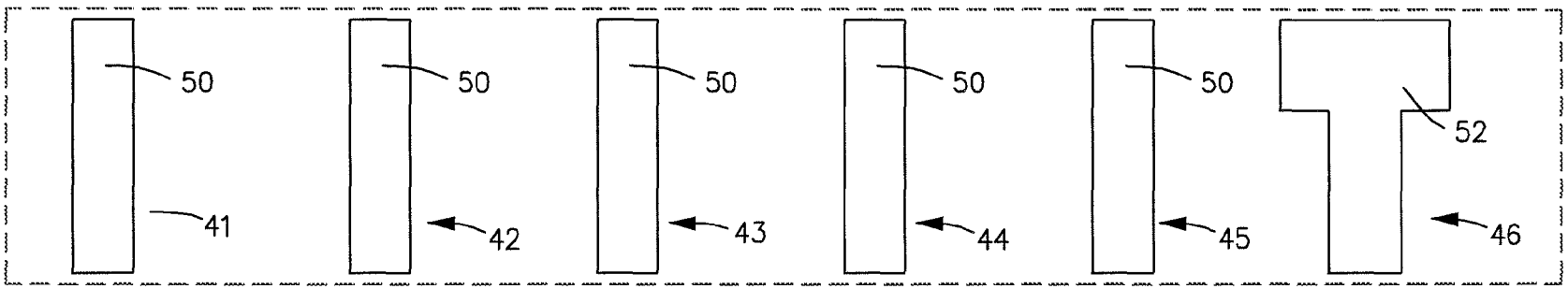

FIGS. 4*a*-4*e* illustrate a number of other possible economical hammer configurations contemplated by the present invention. Referring to FIG. 4*e*, a low energy consumption configuration is shown wherein the first five rows of hammers 41-45 are bar hammers to provide low energy crushing of the particles, and the last row of hammers 46 being T-shaped hammers for crushing the finer particles before exiting the imp mill.

The present invention however contemplates any possible configuration of hammers 30 as well as any shape of hammer to provide the desired output of ground material whereby the desired particle size is provided and/or the wear of the hammers are substantially even or uniform.

While the present invention provides embodiments having features for providing relatively even wear across the rows 41-46 of hammers 30, the present invention contemplates that the features of each embodiment may be combined to provide an imp mill 10 having rows of hammers of varying hammer shapes with having varying degrees of wear resistance and/or hardness. For example, the economical configurations shown in FIGS. 4*a*-4*e* may also include hammers formed of or coated with varying degrees of wear resistance, such that the hammers of the mill economically pulverize the particles to the desired size and provide uniform wear of the hammers. For instance referring to FIG. 4*e*, at least the first row of bar hammers 41 may be coated or formed of wear resistant material to provide such an economical, uniform wear, and particle controlled configuration.

While the spacing of circumferential spacing of hammers 30 of each row 41-46 is shown and described as being substantially equal, the present invention further contemplates that the circumferential spacing may not be substantially equal. Further, while each row of hammers is described as having the same number of hammers, the present invention contemplates that the number of hammers in each row may be different between rows as well as the spacing between hammers may be different. The present invention further contemplates that the alignment of the hammers may be different than that described hereinbefore. For example, the hammers of the first and fourth rows 41,44, respectively may be aligned, the hammers of second and fifth rows 42,45, respectively, may be aligned, and the third and sixth rows 43,46 respectively, may be aligned. It is also contemplated that none of the hammers in any row are aligned. While six rows of hammers are described, the present invention contemplates that any number of rows (e.g., 2, 3, 4, 5, 7, 8, 9, or 10 rows) may be used depending on the material and required fineness of the resulting ground material.

While the hammers 30 are shown and described as being pivotally attached to the hammer disks 32, the hammers may be fixedly attached to the hammer disks.

While the imp mill embodying the present invention shows and describes each hammer disk 32 having at least one hammer 30 attached thereto, the present invention contemplates that at least one hammer disk may have no hammers 30 attached thereto to thereby provide a greater spacing between adjacent rows of hammers adjacent to the hammerless disk. For example referring to FIG. 1, the hammer disk of row 43 may not have any hammers disposed thereto, and thus providing a gap between rows 42 and 44 greater than the gap between row 44 and row 45. It is also contemplated that a plurality of hammer disks may not have hammers in any pattern of disks with and without hammers, such as every other interior row (e.g., rows 43 and 45) are missing hammers, or adjacent rows (e.g., rows 43 and 44) are missing hammers.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for pulverizing material, said apparatus comprising:

a housing defining a grinding chamber;

an inlet conduit for feeding the material into the grinding chamber;

an outlet conduit for directing pulverized material from the grinding chamber;

a plurality of hammer disks axially spaced along a shaft, wherein the hammer disks are disposed within the grinding chamber;

a plurality of rows of at least one hammer, each of the plurality of rows being defined by an adjacent pair of the hammer disks, the at least one hammer being attached to and between the adjacent pair of the hammer disks, and each of the plurality of rows defining a wear susceptibility parameter, at least one of the wear susceptibility parameters of one of the plurality of rows being different from another wear susceptibility parameter of another of the plurality of rows; and each of the plurality of rows being selectively positioned in the housing according to the wear susceptibility parameters, such that a wear rate of each of the hammers is substantially equal for all the hammers.

2. The apparatus of claim 1, wherein at least one of the hammers is formed having more wear resistant material than at least one other of the hammers.

3. The apparatus of claim 1, wherein at least one of the hammers in at least one of the plurality of rows is formed having more wear resistant material than at least one other of the hammers in at least another one of the plurality of rows.

4. The apparatus of claim 1, wherein at least one of the hammers is coated with a wear resistant material that provides a greater wear resistance than at least one other of the hammers.

5. The apparatus of claim 1, wherein selected hammers are heat treated to be more wear resistant than other hammers.

6. The apparatus of claim 1, wherein at least one hammer is fixedly attached to the hammer disks.

7. The apparatus of claim 1, wherein at least one hammer is pivotally attached to the hammer disks.

8. The apparatus of claim 1, wherein the hammers are formed of different shapes.

9. The apparatus of claim 8, wherein the shapes include at least one of bar hammer, T-shaped hammer, L-shaped hammer, and paddle hammer.

10. The apparatus of claim 1, wherein the hammers of the row of hammers nearest the inlet conduit are bar hammers.

11. The apparatus of claim 1, wherein the hammers of the row of hammers nearest the outlet conduit are T-shaped hammers or paddle hammers.

12. The apparatus of claim 1, wherein the plurality of rows of hammers include 2, 3, 4, 5, 6, 7, 8, 9, or 10 rows of hammers.

13. The apparatus of claim 1, wherein the plurality of rows of hammers include at least two rows of hammers whereby the shape of hammers in one row are different than the shape of the hammers of another row.

14. The apparatus of claim 1, wherein the apparatus is at least one of a hammermill or an imp mill.

15. The apparatus of claim 1, wherein the row of hammers nearest the inlet conduit is formed to a greater wear resistance than at least one subsequent row of hammers.

16. The apparatus of claim 1, wherein the row of hammers nearest the inlet conduit and the row closest to the outlet conduit have a greater wear resistance than at least one subsequent row of hammers disposed therebetween.

17. An apparatus for pulverizing material, said apparatus comprising:

a housing defining a grinding chamber;

an inlet conduit for feeding the material into the grinding chamber;

an outlet conduit for directing pulverized material from the grinding chamber;

a plurality of hammer disks axially spaced along a shaft, wherein the hammer disks are disposed within the grinding chamber;

a plurality of rows of at least one hammer, each of the plurality of rows being defined by an adjacent pair of the hammer disks, the at least one hammer being attached to and between the adjacent pair of the hammer disks, and each of the plurality of rows defining a wear susceptibility parameter, at least one of the wear susceptibility parameters of one of the plurality of rows being different from another wear susceptibility parameter of another of the plurality of rows; and each of the plurality of rows being selectively positioned in the housing according to the wear susceptibility parameters, such that a wear rate of each of the hammers is substantially equal for all the hammers; and at least one of the hammers has a first shape and at least another of the hammers has a second shape, the first and second shapes being operable to affect the wear rate of the respective hammer.

18. The apparatus of claim 17, wherein the hammers differ in at least one of material, or coatings to provide different wear properties.

* * * * *